US009739130B2

(12) United States Patent
Young

(10) Patent No.: US 9,739,130 B2
(45) Date of Patent: Aug. 22, 2017

(54) FLUID END WITH PROTECTED FLOW PASSAGES

(71) Applicant: ACME INDUSTRIES, INC., Elk Grove Village, IL (US)

(72) Inventor: Fred Young, Naperville, IL (US)

(73) Assignee: Acme Industries, Inc., Elk Grove Village, IL (US)

( * ) Notice: Subject to any disclaimer, the term of this patent is extended or adjusted under 35 U.S.C. 154(b) by 156 days.

(21) Appl. No.: 14/776,530

(22) PCT Filed: Mar. 14, 2014

(86) PCT No.: PCT/US2014/028390
§ 371 (c)(1),
(2) Date: Sep. 14, 2015

(87) PCT Pub. No.: WO2014/144113
PCT Pub. Date: Sep. 18, 2014

(65) Prior Publication Data

US 2016/0032701 A1 Feb. 4, 2016

Related U.S. Application Data

(60) Provisional application No. 61/800,852, filed on Mar. 15, 2013.

(51) Int. Cl.
*F04B 53/16* (2006.01)
*E21B 43/26* (2006.01)
(Continued)

(52) U.S. Cl.
CPC ..... *E21B 43/26* (2013.01); *F04B 19/22* (2013.01); *F04B 53/007* (2013.01); *F04B 53/10* (2013.01);
(Continued)

(58) Field of Classification Search
CPC ..... F04B 53/007; F04B 53/10; F04B 53/14; F04B 53/16; F04B 53/166; F04B 53/168; E21B 43/26
See application file for complete search history.

(56) References Cited

U.S. PATENT DOCUMENTS 2,686,090 A 2/1951 Leman
2,841,092 A 7/1958 Whiteman et al.
(Continued)

FOREIGN PATENT DOCUMENTS

GB 1235173 6/1968
WO WO2012052842 A2 4/2012

OTHER PUBLICATIONS

International Search Report and Written Opinion for PCT/US2014/028390, dated May 23, 2014.
(Continued)

*Primary Examiner* — Thomas E Lazo
(74) *Attorney, Agent, or Firm* — Cook Alex Ltd.

(57) ABSTRACT

Fluid end for high pressure reciprocating pump, in particular for hydraulic fracturing pumps, comprising: a body having a first bore (18) for receiving a reciprocating plunger (31), a second bore (19) for accommodating a suction valve (41), and a third bore (21) for accommodating a discharge valve (43), the second bore (19) and the third bore (21) being perpendicular to the first bore (18); at least a tubular sleeve (30) in said first bore (18); at least a tubular cartridge (30) in the second bore and/or third bore; and a fluid tight seal between contacting surfaces of said sleeve (30) and said cartridge (30).

38 Claims, 18 Drawing Sheets

(51) Int. Cl.

| | |
|---|---|
| ***F04B 53/00*** | (2006.01) |
| ***F04B 19/22*** | (2006.01) |
| ***F04B 53/10*** | (2006.01) |
| ***F04B 53/14*** | (2006.01) |

(52) U.S. Cl.
CPC ..... *F04B 53/14* (2013.01); *F04B 53/16* (2013.01); *F04B 53/166* (2013.01); *F04B 53/168* (2013.01)

(56) References Cited

U.S. PATENT DOCUMENTS

| | | | | |
|---|---|---|---|---|
| 3,077,836 | A | 2/1963 | Coberly | |
| 3,438,334 | A | 4/1969 | Schaaf | |
| 3,507,584 | A * | 4/1970 | Robbins, Jr. | F04B 1/124 417/439 |
| 3,510,233 | A * | 5/1970 | Habegger | F04B 39/12 417/454 |
| 3,786,729 | A | 1/1974 | Rizzone | |
| 3,801,234 | A | 4/1974 | Love et al. | |
| 3,870,439 | A | 3/1975 | Stachowiak et al. | |
| 4,304,533 | A * | 12/1981 | Buckell | B29C 39/10 264/271.1 |
| 4,486,938 | A | 12/1984 | Hext | |
| 4,508,133 | A | 4/1985 | Hamid | |
| 4,573,886 | A * | 3/1986 | Maasberg | F04B 53/10 417/454 |
| 4,878,815 | A | 11/1989 | Stachowiak | |
| 5,061,159 | A | 10/1991 | Pryor | |
| 5,073,096 | A | 12/1991 | King et al. | |
| 5,145,340 | A | 9/1992 | Allard | |
| 5,253,987 | A | 10/1993 | Harrion | |
| 5,617,773 | A | 4/1997 | Craft et al. | |
| 6,230,610 | B1 | 5/2001 | Pippert | |
| 6,382,940 | B1 | 5/2002 | Blume | |
| 6,463,843 | B2 | 10/2002 | Pippert | |
| 6,544,012 | B1 | 4/2003 | Blume | |
| 6,623,259 | B1 | 9/2003 | Blume | |
| 6,910,871 | B1 | 6/2005 | Blume | |
| 7,121,812 | B2 | 10/2006 | Forrest | |
| 7,186,097 | B1 | 3/2007 | Blume | |
| 7,335,002 | B2 | 2/2008 | Vicars | |
| 7,341,435 | B2 | 3/2008 | Vicars | |
| 7,364,412 | B2 | 4/2008 | Kugelev et al. | |
| 7,404,704 | B2 | 7/2008 | Kugelev et al. | |
| 7,484,452 | B2 | 2/2009 | Baxter et al. | |
| 7,789,133 | B2 | 9/2010 | McGuire | |
| 7,828,053 | B2 | 11/2010 | McGuire et al. | |
| 8,100,175 | B2 | 1/2012 | McGuire et al. | |
| 8,100,407 | B2 | 1/2012 | Stanton et al. | |
| 8,113,275 | B2 | 2/2012 | McGuire et al. | |
| 8,147,227 | B1 | 4/2012 | Blume | |
| 2004/0234404 | A1 | 11/2004 | Vicars | |
| 2007/0251578 | A1 | 11/2007 | McGuire | |
| 2008/0080994 | A1 | 4/2008 | Gambier | |
| 2008/0138224 | A1 | 6/2008 | Vicars | |
| 2008/0213112 | A1 | 9/2008 | Lucas | |
| 2010/0158727 | A1 | 6/2010 | Hawes et al. | |
| 2011/0206546 | A1 | 8/2011 | Vicars | |
| 2012/0148430 | A1 | 6/2012 | Hubenschmidt et al. | |

OTHER PUBLICATIONS

Office Action dated Apr. 11, 2016, U.S. Appl. No. 14/210,931.
Office Action dated Apr. 11, 2017, U.S. Appl. No. 14/210,931.
Office Action dated Apr. 11, 2016, U.S. Appl. No. 14/211,027.
Office Action dated Mar. 21, 2017, U.S. Appl. No. 14/211,027.

* cited by examiner

Fig. 31
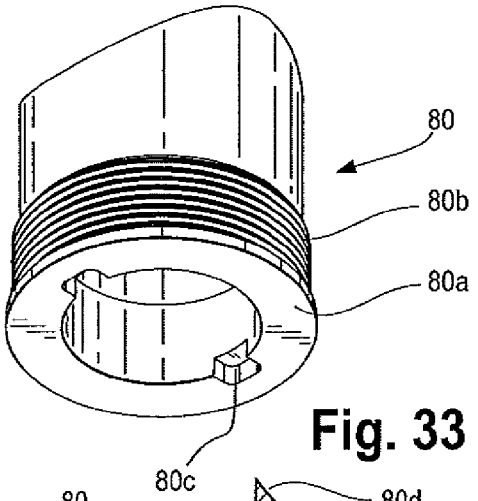
Fig. 32
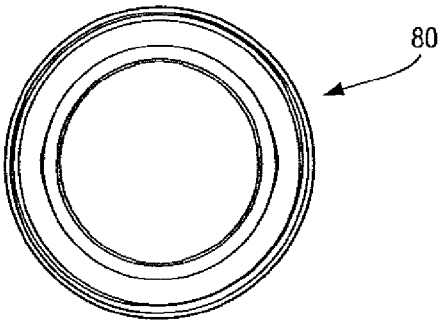
Fig. 33
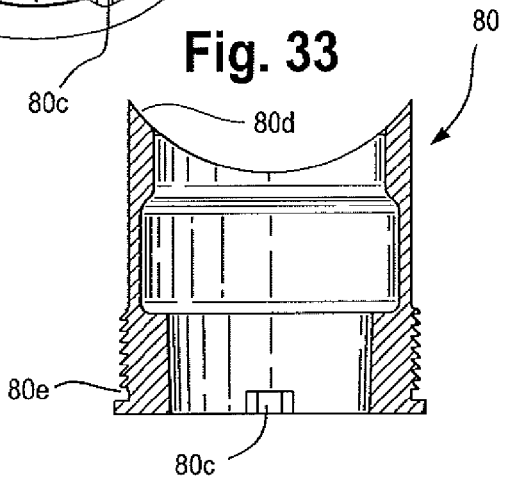
Fig. 34
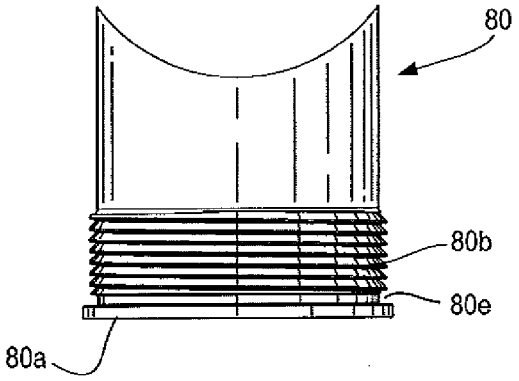
Fig. 35
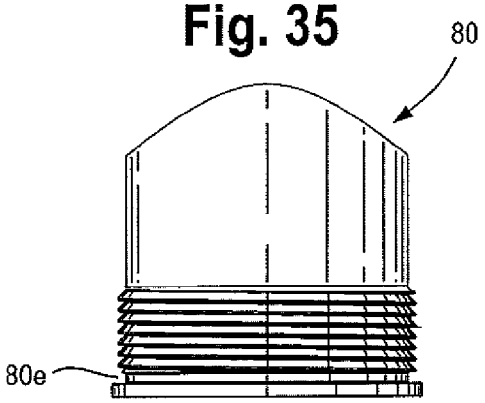
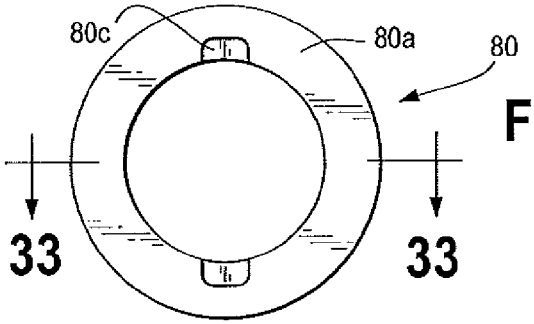
Fig. 36

FLUID END WITH PROTECTED FLOW PASSAGES

CROSS-REFERENCE TO RELATED APPLICATION

This application claims priority from U.S. Non-Provisional application Ser. Nos. 14/210,931 and 14/211,017, each of which claims priority from U.S. Provisional Patent Application Ser. No. 61/800,852, filed Mar. 15, 2013, the disclosure of all of which are hereby incorporated by reference in their entireties.

FIELD OF THE INVENTION

The present invention generally relates to hydraulic fracturing pump systems and, more particularly, to the fluid ends of multiplex reciprocating fracturing pumps.

BACKGROUND

Multiplex reciprocating pumps are generally used to pump high pressure fracturing fluids into wells for recovery of oil and gas trapped in shale formations and the like. Typically, these pumps have two sections, a power end which is coupled to a diesel engine and transmission that drives the pump and plungers in the fluid ends in which a mix of water, sand and chemicals are pressurized up to 15,000 psi or more.

These multiplex reciprocating pumps are commonly in the form of triplex pumps having three fluid cylinders and quintuplex pumps that have five cylinders. It will be appreciated, however, that the present disclosure has application to pumps which can utilize the features thereof in forms other than the triplex and quintuplex pumps. The fluid ends of these pumps typically comprise a single block having cylinders bored therein and are commonly referred to as monoblock fluid ends or an assembly of individual bodies with cylinders, referred to as modular fluid ends.

The pumping cycle of a fluid end is composed of two stages, a suction cycle during which a piston moves outward in a bore, thereby lowering the fluid pressure in the inlet to a fluid end and a discharge cycle during which the plunger moves forward in the plunger bore, thereby progressively increasing the fluid pressure to a predetermined level for discharge through a discharge pipe to a well site.

Fluid ends used in well site applications for oil and gas exploration have limited service life due to fatigue crack failures. These failures are a result of operating pressures, mechanical stresses, erosion and corrosion of the internal passages which have been addressed in prior art efforts with limited success.

Discussion of the Prior Art

International Application No. PCT/IB2011/002771 (International Publication No. WO 2012 052842 A2 entitled "Fluid End Reinforced With Abrasive Resistant Insert, Coating or Lining") describes the use of inserts in wear prone areas only and, as such, does not provide erosion, corrosion and fatigue crack protection throughout the entire flow passages in the fluid end.

U.S. Patent Publication 2008/0080994 A1, "Fluid End Reinforced With a Composite Material," is directed to a fluid end of a reciprocating pump wherein carbon steel thin base material is formed into three tubes which are welded and then hydroformed to give a cross-like configuration. That structure is reinforced with a composite that provides some additional stress resistance and reduced weight, however, it does not utilize the inherent benefits of the originally designed high strength steel in the fluid block.

U.S. Pat. No. 3,786,729 is directed to a liner seal for the plunger bore and does not address the protection of high stress areas such as those associated with intersecting bores.

SUMMARY OF THE INVENTION

This disclosure is generally directed to systems for substantially protecting the portions of the fluid end body flow passages from impingement by high pressure fracking fluid passing therethrough to provide enhanced erosion and corrosion resistance as well as improved fatigue properties and extended service life.

A first aspect of this disclosure is directed to one or more sleeve components sleeve components and/or one or more cartridge components which cooperate to protect flow passages in fluid end body portions surrounding the outer surface thereof from direct impingement thereon by high pressure fracking fluid passing through said fluid end.

A further aspect of this disclosure is directed to a sleeve that is received in a plunger bore of a fluid end body which sleeve includes a pair of apertures that are connected to, and in flow communication with, the outlet of the suction bore and the inlet of in the discharge bore.

In accordance with another aspect of the disclosure, a kit which includes one or more sleeves, and/or one or more cartridges are provided for installation in a conventional fluid end steel body which, when installed therein, cooperate to protect the fluid end body portions surrounding the outer surfaces thereof from impingement by high pressure fracking fluid passing through said fluid end.

A further aspect of the present invention is directed to a method of installing one or more components in the flow passages of a fluid end body of a reciprocating pump used in the recovery of oil and gas for the purpose of extending the service life thereof and to minimize the effects of erosion, corrosion and fatigue, such components being configured and located within one or more bores in said fluid end body to protect the portions of said fluid end body surrounding those components including portions thereof associated with high stress areas such as the corners of intersecting bores.

It is to be understood that the foregoing general description and the following detailed description are exemplary and provided for purposes of explanation only and are not restrictive of the subject matter claimed. Further features and objects of the present disclosure will become apparent in the following description of the example embodiments and from the appended claims.

DESCRIPTION OF THE DRAWINGS

In describing the preferred embodiments, reference is made to the accompanying drawing figures or in like parts have like reference numerals and wherein:

FIG. 31 is a perspective view of a lower cartridge component of said further embodiment;

FIG. 32 is a top plan view of the lower cartridge component of FIG. 31;

FIG. 33 is a sectional view of the lower cartridge component shown in FIGS. 32 and 33, taken along the section line 33-33 of FIG. 3C;

FIGS. 34 and 35 are side elevational views of the lower cartridge component shown in FIGS. 31-33;

FIG. 36 is a bottom plan view of the lower cartridge component shown in FIGS. 31-35;

DETAILED DESCRIPTION OF THE INVENTION

In accordance with an important aspect of the present disclosure, the subject invention is particularly suited for use in existing fluid end designs, however, it is not restricted to those designs and can be utilized in other high pressure pumping applications where operating pressures, mechanical stresses, erosion and corrosion of internal passages are a concern. For the purpose of illustration, however, it will be described in conjunction with a conventional triplex fluid end such as is generally shown in FIGS. 1-5.

Figure 1:
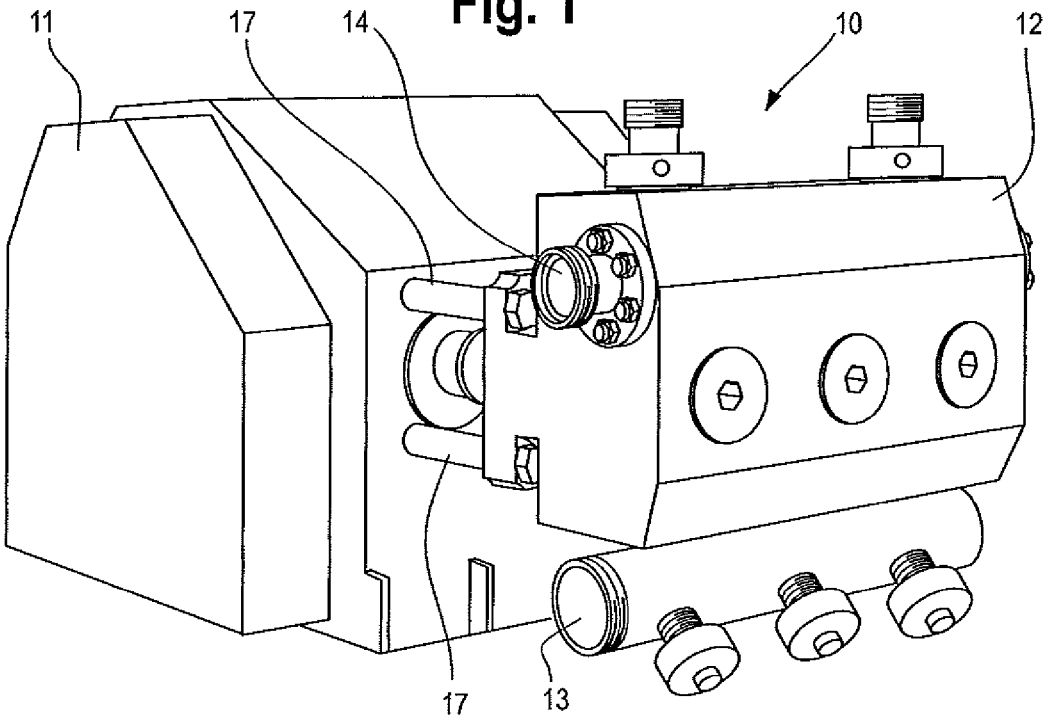
FIG. 1 is a schematic illustration of a power end and fluid end of a reciprocating pump used in the recovery of oil and natural gas.

Referring to FIG. 1, a triplex reciprocating pump system is generally designated by the reference numeral 10 and includes a power end 11, typically driven by a diesel engine and transmission, which is coupled to a pump body or fluid end 12 that is supplied with water and other ingredients for the fracking fluid via an inlet 13. It is pressurized in the fluid end and discharged through a high pressure outlet 14 therein. Fluid end 12 includes a mounting surface 16 which can be used to directly secure the fluid end to the power end by plurality of bolts 17.

As best shown in FIGS. 2-5, the fluid end 12 includes, a block 12*a* formed from a high strength steel forging, which is machined to provide a first or plunger bore 18, a second or suction bore 19, center chamber 20 for pressurization of the fracking fluid and a third bore or high pressure discharge bore 21. Each of the high pressure discharge bores 21 shown in FIG. 5 feeds into a common internal high pressure discharge passage 22 which directly communicates with the high pressure discharge outlet 14.

Figure 22:
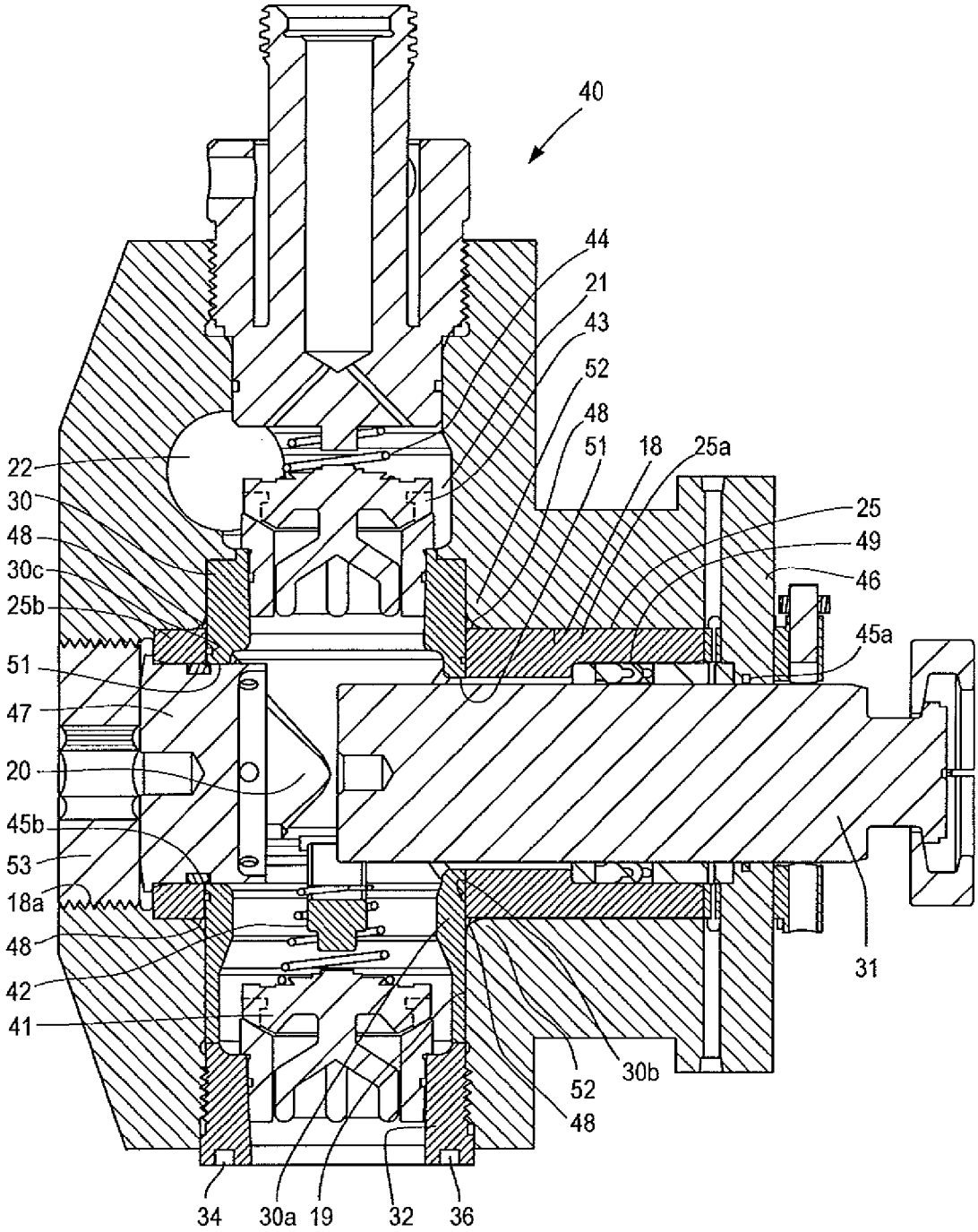
FIG. 22 is a schematic view, partially in section, illustrating the assembly of the components of the first embodiment of the present disclosure.

The components of this first disclosed embodiment include a sleeve component, the details of which are shown in FIGS. 6-9, a cartridge component, the details of which are shown in FIGS. 10-14, a combination retainer/positioning plug, the details of which are shown in FIGS. 15-19 and the assembly of these components with conventional internal valves, seals, etc. are shown in FIG. 22.

In FIGS. 6-9, the cylindrical sleeve component of the first disclosed embodiment is designated by the reference numeral 25 and can be composed of stainless steel, Inconel® and Incoloy® and other metal and alloys exhibiting suitable corrosion and erosion resistance and strength. If desired, coatings and surface treatments may be applied to the surfaces of the sleeves to improve the corrosion and erosion characteristics thereof. As shown, sleeve component 25 includes a first sleeve portion 25*a*, a second sleeve portion 25*b* which are coupled to each other by integral interconnecting bridge portion 25*c* and 25*d*. The outer surfaces of the first and second sleeve portions 25*a* and 25*b* are configured to be respectively received in direct contact with a first portion of the first bore, the plunger bore and a second portion of the first bore that can also be referred to as an access bore.

Sleeve 25 also includes a pair of flow passage apertures 26 and 27 defined by inner edges of bridge portions 25*c* and 25*d* which are configured to be in alignment with the second or suction bore 19 and third or high pressure discharge bore 21 when the sleeve is installed in a fluid cylinder of the fluid end 12.

If desired, first tubular sleeve portion 25*a* and second tubular sleeve portion 25*b* may be in the form of two separate sleeves (without the interconnecting bridge portions) which are respectively received in the first and second portions of the first bore, namely the plunger and access bores.

Figure 23:
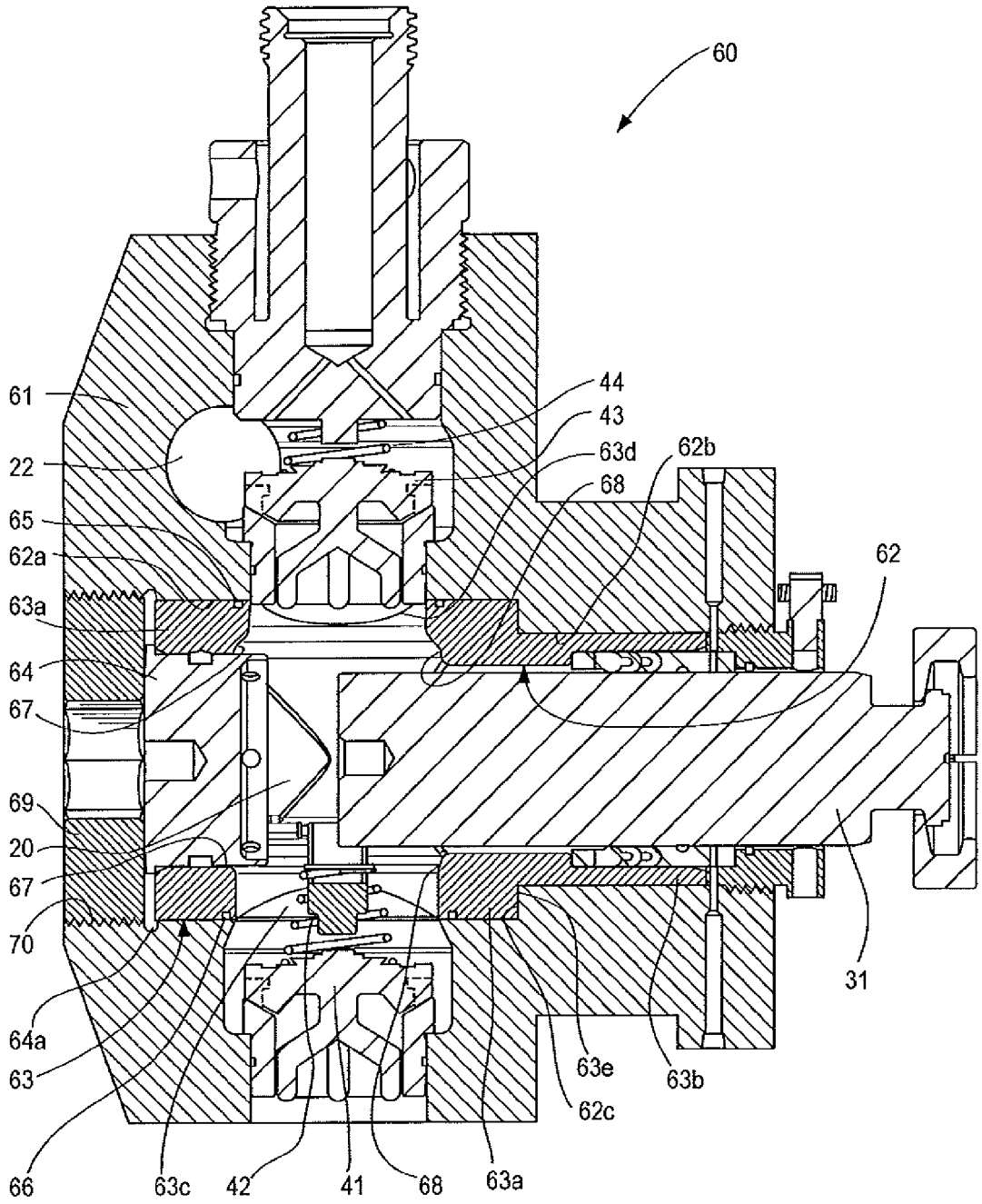
FIG. 23 is an assembly drawing, partially in section, illustrating another embodiment of the present disclosure which utilizes a single sleeve component.

In FIGS. 10-14, the cylindrical cartridge component of the first disclosed embodiment is designated by the reference numeral 30. As shown, cartridge component includes a first portion 30*a* which is configured to be received in the second or suction bore 19, a pair of apertures 30*b* and 30*c*, an upper portion 30*d* are configured to be received in the third or high pressure discharge bore 30*d* and a bottom edge 30*e* that engages a removable plug which will be more fully described below. As with sleeve 25, the cartridge 30 can be composed of stainless steel, Inconel®, Incoloy® as well as other metals and alloys. Correspondingly, coatings and surface treatments may be applied to the surfaces of the cartridge to improve the corrosion and erosion characteristics thereof. Apertures 30*b* and 30*c* are positioned to be in alignment with the first and second portions of the first bore and the center chamber 20 for accommodating the reciprocal movement of a plunger 31 (FIG. 23).

As will be described more fully later in conjunction with FIG. 22, the perimeter of each aperture 30*a* and 30*b* includes a full perimeter groove in which a gasket is received. These gaskets can be formed from a suitable material which can withstand the high pressures, chemicals and other conditions associated with fracking operations and can include elastomers and synthetic fluorocarbon polymers which exhibit these properties.

In accordance with an important aspect of this disclosure, the sleeves and cartridges can be machined and/or surface treated prior to their assembly into the block. This feature provides greater flexibility in shaping the internal cylinder contours, resulting in improved performance and durability of the fluid end.

In some applications, it may be preferred to machine the mating fluid end bore surfaces and the outside surfaces of the sleeves and cartridge inserts to standard dimensions while machining the internal surfaces to address the required configurations. If desired, stress in the fluid end block may be reduced by increasing the thickness of the sleeve and cartridge cylinder to optimize the contours of the interfacing surfaces of the fluid end block. For example, by having a larger radius between intersecting bores of the block.

The tubular plug component of this disclosed embodiment is separately shown in FIGS. 15-19 and designated by the reference numeral 32 which includes top end face having an annular rim 32*a* configured for direct contact with cartridge bottom edge 30(*e*) and a threaded annular sidewall 32*b* that is matingly received in the threaded lower end of the second or suction bore 19 of fluid end 20. Plug 32 is sized to secure cartridge 30 in a fixed operating position in the second and third bores with the apertures 30*b* and 30*c* in alignment with the first or plunger bore 18. As shown, wrench-receiving recesses 33-36 can be provided in the bottom end face 32*c* of plug 32 to facilitate its installation and removal in and to the fluid end 12.

Figure 2:
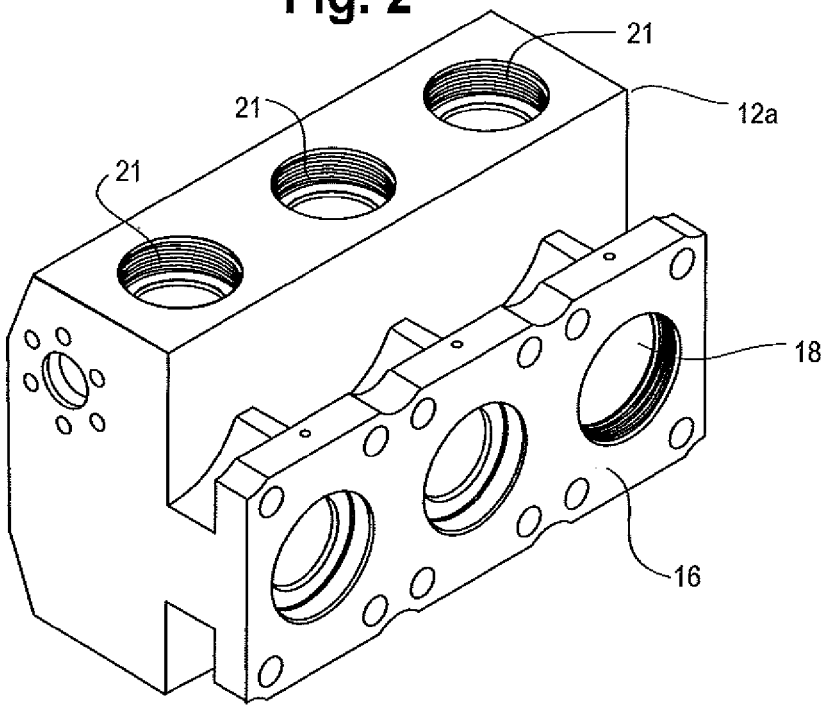
FIG. 2 is a perspective view of the block component of the fluid end shown in FIG. 1.
Figure 3:
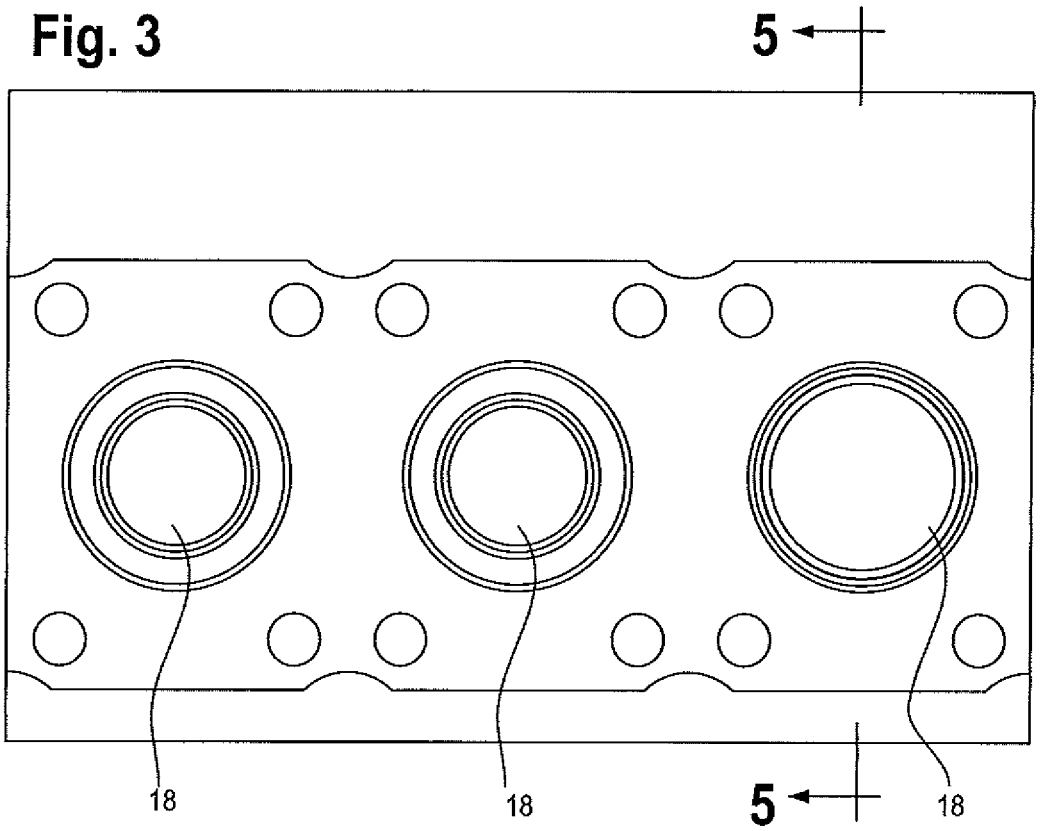
FIG. 3 is a side elevational view as seen from the mounting flange surface of the fluid end block shown in FIGS. 2 and 3.
Figure 4:
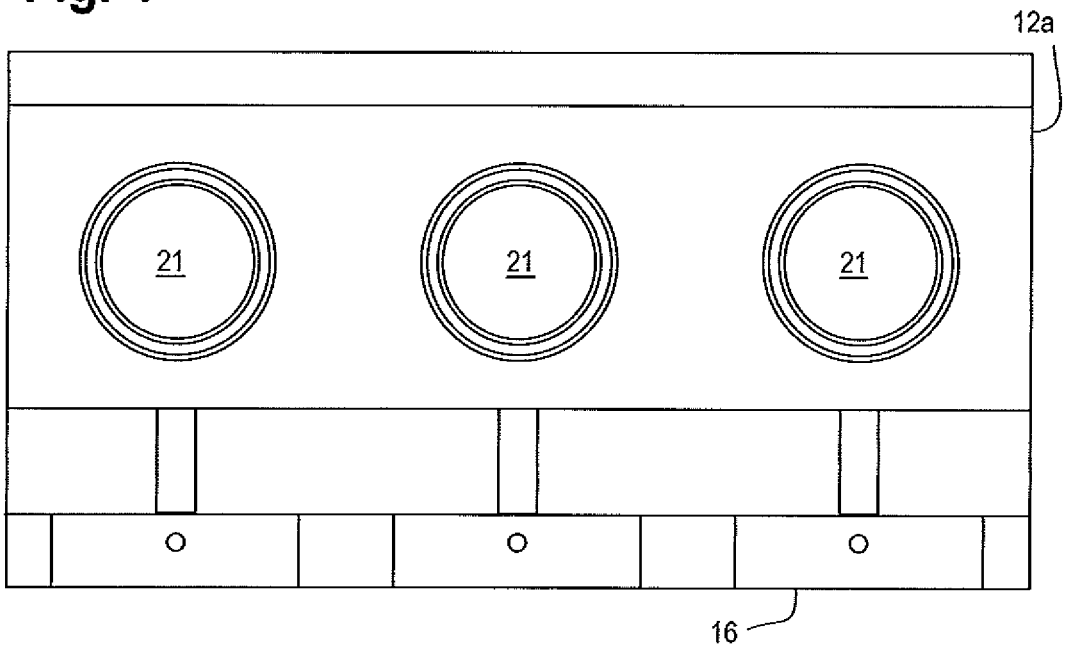
FIG. 4 is a top plan view of the fluid end block shown in FIG. 2.
Figure 5:
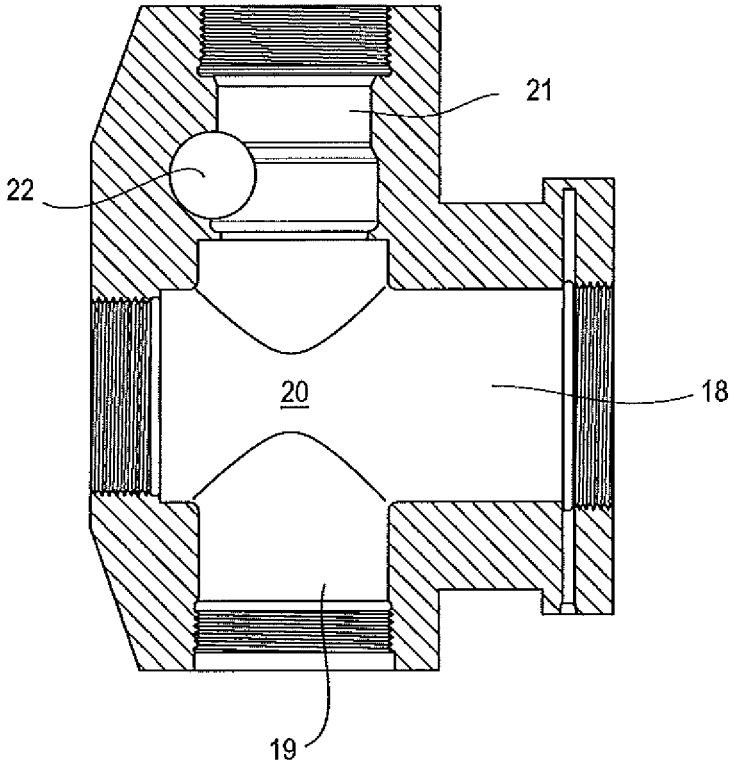
FIG. 5 is a sectional view of the fluid end block shown in FIG. 3 taken along the sectional line 5-5 of FIG. 3 which has been modified to accept the components of the first embodiment described herein, but prior to the installation of such components.
Figure 6:
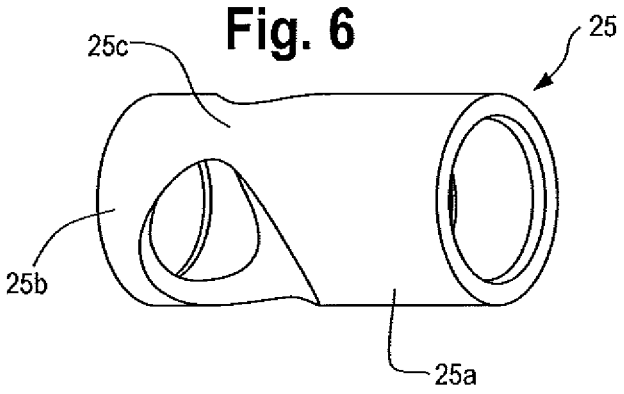
FIG. 6 is a perspective view of a sleeve component suitable for use in accordance with the first embodiment of the present disclosure.
Figure 7:
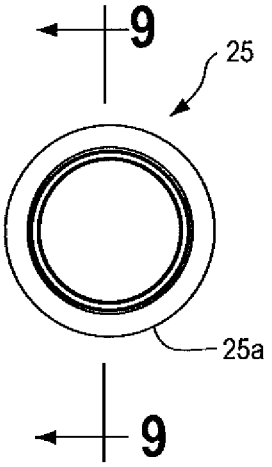
FIG. 7 is an end view of the sleeve shown in FIG. 6.
Figure 8:
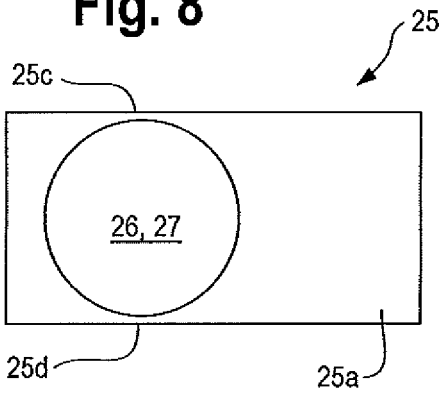
FIG. 8 is a side elevational view of the sleeve shown in FIGS. 6 and 7.
Figure 9:
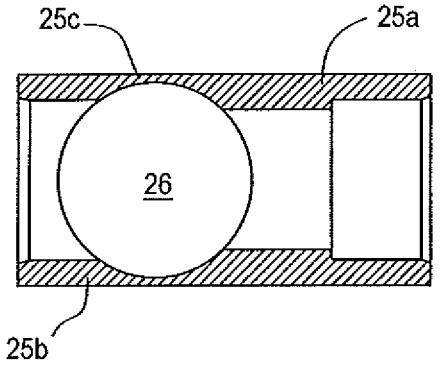
FIG. 9 is a sectional view of the sleeve shown in FIGS. 6-8 taken along the section line 9-9 of FIG. 7.
Figure 10:
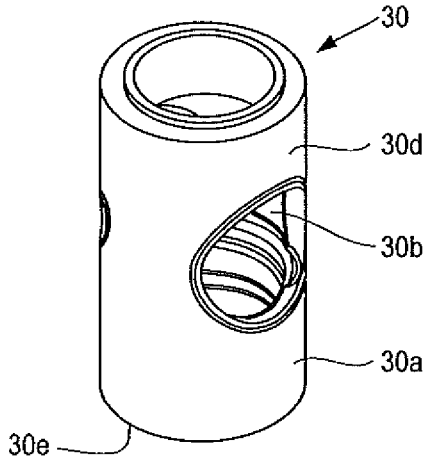
FIG. 10 is a perspective view of a cartridge component suitable for use in the first embodiment of this disclosure.
Figure 11:
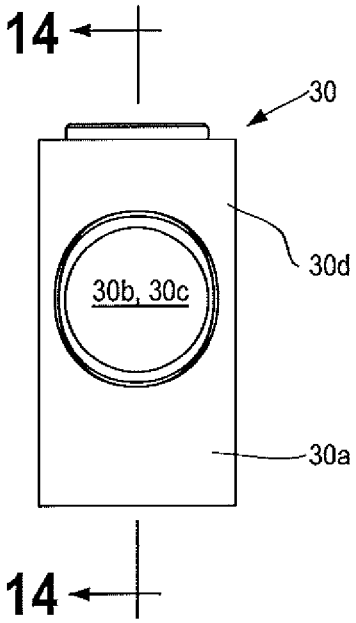
FIG. 11 is a front elevational view of the cartridge shown in FIG. 10.
Figure 13:
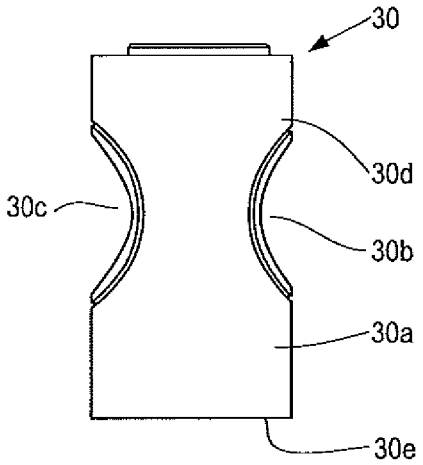
FIG. 13 is a side elevational view of the cartridge shown in FIGS. 10-12.
Figure 12:
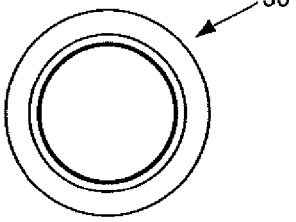
FIG. 12 is an end view of the cartridge component shown in FIGS. 10-11.
Figure 14:
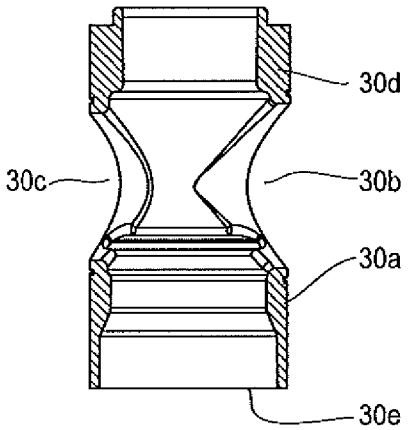
FIG. 14 is a sectional view of the cartridge shown in FIGS. 10-13 taken along the line 14-14 of FIG. 11.
Figure 15:
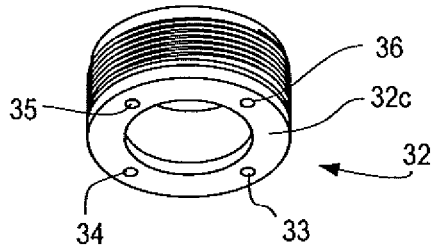
FIG. 15 is a perspective view of a tubular plug suitable for use in the first embodiment of this disclosure.
Figure 16:
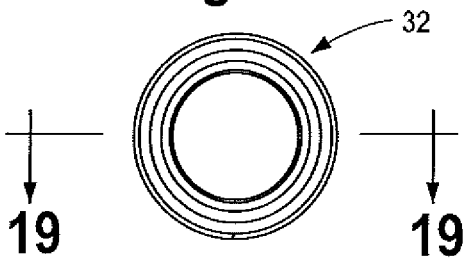
FIG. 16 is a top plan view of the tubular plug (spacer) shown in FIG. 15.
Figure 17:
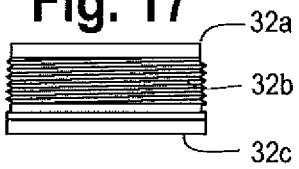
FIG. 17 is a side elevational view of the component shown in FIGS. 15 and 16.
Figure 19:
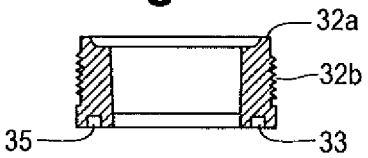
FIG. 19 is a sectional view of the component shown in FIGS. 15-18 taken along the section line 19-19 of FIG. 16.
Figure 18:
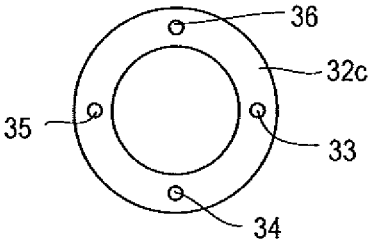
FIG. 18 is a bottom plan view of the component shown in FIGS. 15-17.
Figure 20:
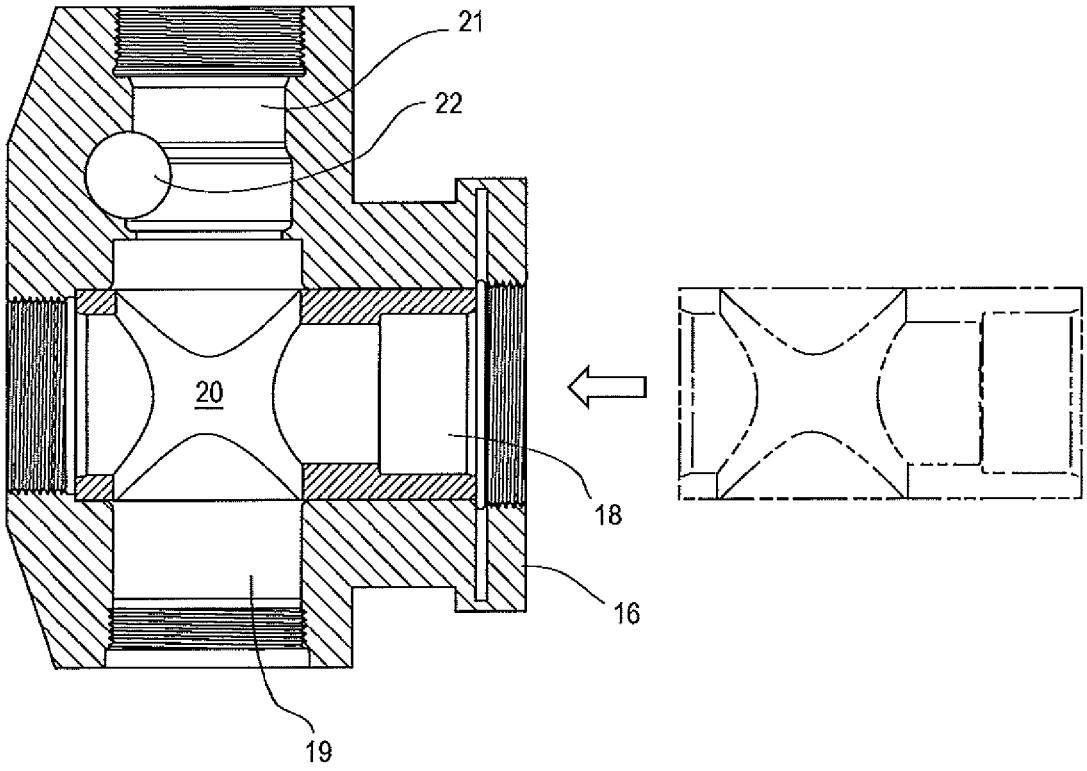
FIG. 20 is a schematic sectional view illustrating a procedure of installing the sleeve component shown in FIGS. 7-10 in a fluid end in accordance with the first embodiment of the present disclosure.

Installation of the sleeve 25 into the first or plunger bore can be made from either end. For example, in the sleeve installation step shown in FIG. 20 of the illustrated embodiment, since the diameters of first bore 18 and sleeve 25 are larger than the diameter of the open end of the bore opposite the mounting flange, access to the bore can be made through the mounting flange surface 16 (FIGS. 2-4). It will be appreciated, however, that if the relative dimensions of bore 18 and sleeve 25 are appropriate, access to the interior of the bore and insertion of the sleeve could be done by removal of the retainer nut 53 (FIG. 22) covering at that open end.

The surface of the bore 18 and sleeve 25 are machined to provide a smooth surrounding surface and to an equally smooth outer surface of the sleeve. In order to insure intimate surface-to-surface direct contact between the bore and sleeve, the sleeve can, if desired, have a slightly larger outer diameter than the bore. A differential temperature between the two is created to provide the necessary clearance during insertion and an interference fit when the temperature of both are normalized.

Figure 21:
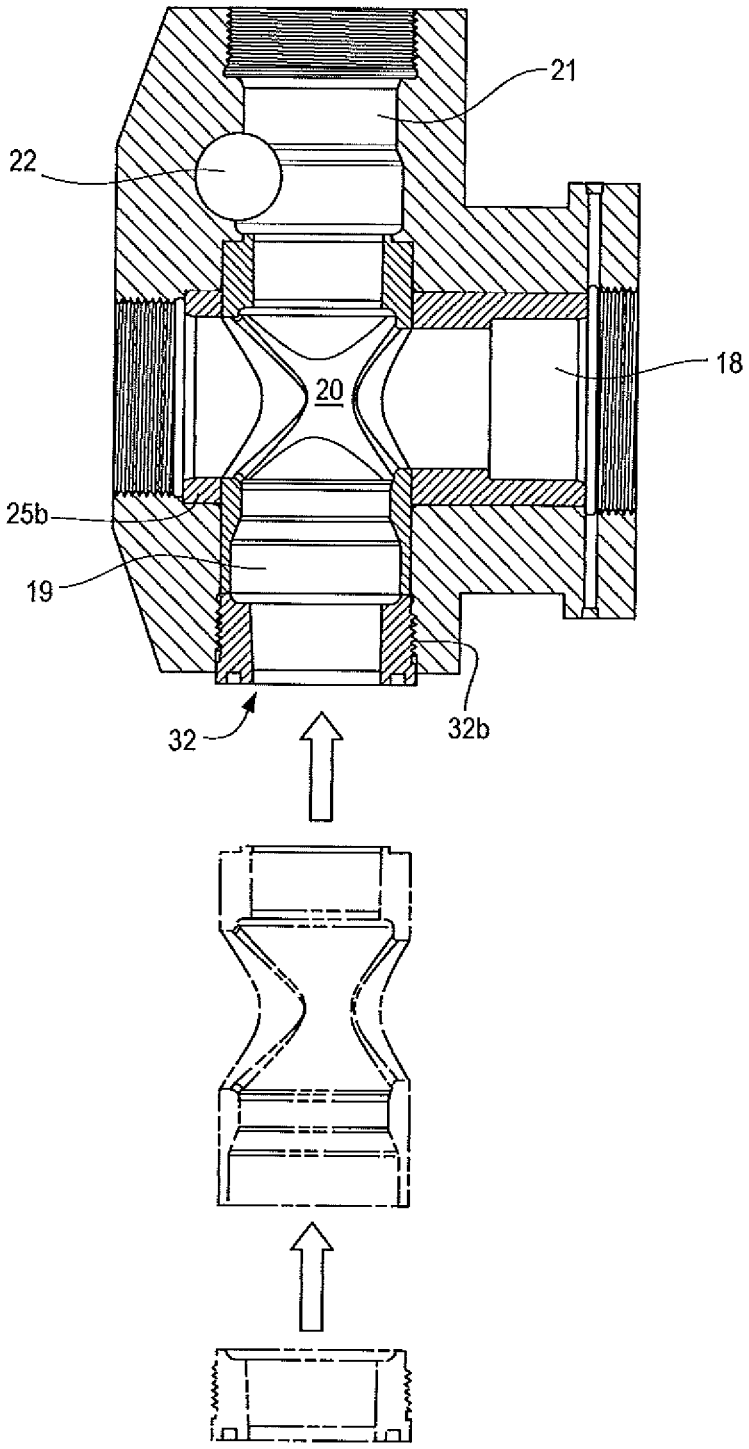
FIG. 21 is a schematic view illustrating a procedure for installing the cartridge of FIGS. 10-14 in a fluid end block in accordance with the first embodiment of the present disclosure.

As schematically depicted in FIG. 21, after the sleeve 25 is installed, the cartridge is also machined to have outer diameter which is again slightly larger than the machined diameters of the second and third bores. A differential temperature between the cartridge and these bores is then created to provide the assembly clearance during this insertion and, when allowed to normalize, to provide a tight, interference fit between the cartridge and the second and third bores.

FIG. 22 illustrates a fluid end cylinder assembly 40 in which the sleeve, cartridge and plug components have been incorporated along with the internal working elements (e.g., plunger, suction valve, high pressure discharge valve, etc.). As shown, plunger 31 is received in the first bore 18 and reciprocates to effect pressurization in the chamber 20 to draw fracking fluid therein, at low pressure from the second or suction bore 19 containing a suction valve 41 and associated intake mechanism 42. Correspondingly, the third high pressure discharge bore 21 receives pressurized fracking fluid from chamber 20 and discharges the same into the internal high pressure passage 22 via discharge valve 43 and associated discharge mechanism 44.

Plunger packing assembly 49 and associated O ring seals in seal carriers 46 and 47 function to prevent or at least minimize passage of fracking fluid to the fluid body portions which surround the sleeve 25 and cartridge 30 components. As shown in FIG. 22, corrosion resistant material strips and beads 48 composed of a titanium-reinforced epoxy putty such as Devcon® (ITW Devon, Danvers, Mass.) can be utilized to minimize or eliminate seepage of tracking fluid into the portions of the fluid end body portions surrounding the sleeve 25 and cartridge 30.

As schematically depicted in FIG. 22, during operation, the regions designated by reference numeral 51 represent the highest stress location in the assembled sleeve and cartridge. Correspondingly, the region designated by the reference numeral 52 represents the highest stress location in the block which is lower than the stress at region 51. Since the sleeve and cartridge components by reason of their composition (e.g., high strength stainless steel, Inconel®, Incoloy®, etc.) provide greater resistance to erosion and corrosion as well as mechanical stresses and fatigue than is provided by the forged steel block, it follows the greater service life results.

Correspondingly, because the stress at the 52 location is less than that at the 51 location it follows that the overall stress on the block is reduced.

As previously noted, each of apertures 30*b* and 30*c* in the cartridge 30 has a perimeter groove in which a gasket is received. Those gaskets provide an effective seal between the outer surface of the cartridge and the edges of apertures 26 and 27 of the sleeve 25 which withstand the high pressure of the fracking fluid in the flow passages.

As shown, an access opening 18*a* at one end of bore 18 receives a removable retaining nut 53 to provide selective access to the interior of the first bore, when desired.

Figure 24:
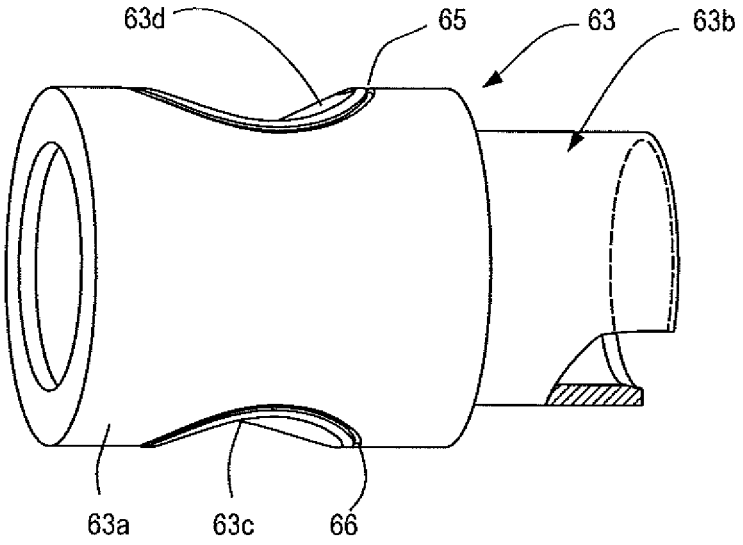
FIG. 24 is a perspective view of a sleeve which can be used in accordance with the embodiment of FIG. 23.
Figure 25:
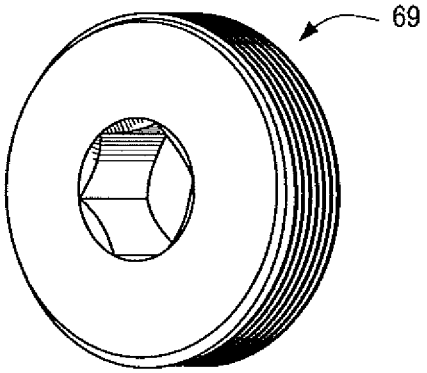
FIG. 25 is a perspective view of a retainer nut suitable for use with the embodiment shown in FIG. 23.
Figure 26:
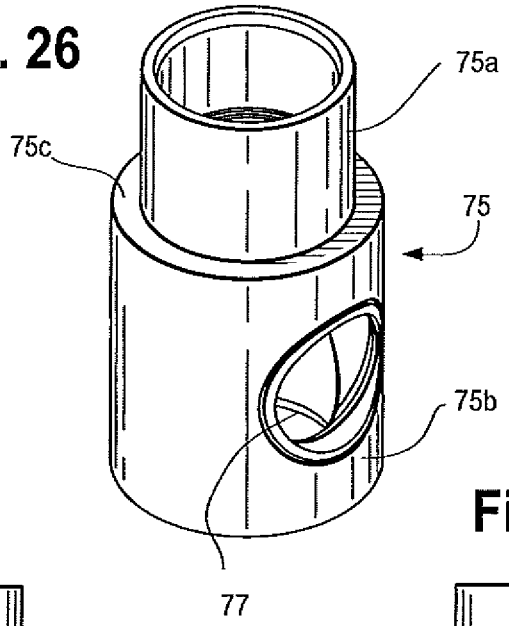
FIG. 26 is a perspective view of a sleeve component suitable for use in a further embodiment of the present invention.
Figure 27:
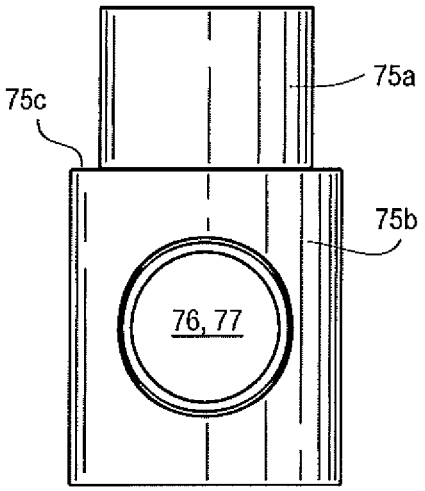
FIG. 27 is a front elevational view of the sleeve of FIG. 26.
Figure 28:
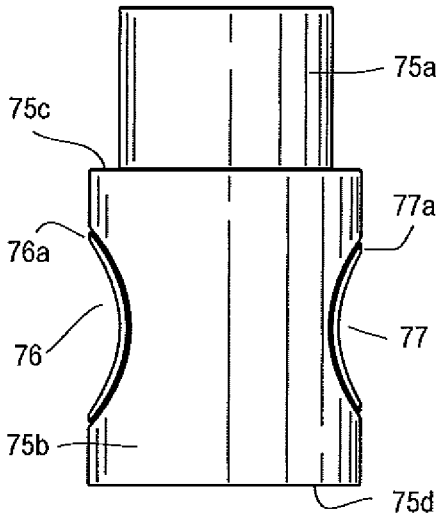
FIG. 28 is a side elevational view of the sleeve shown in FIGS. 26 and 27.
Figure 29:
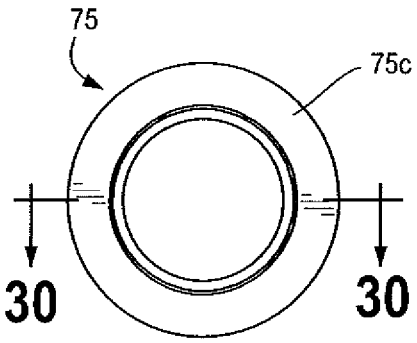
FIG. 29 is a bottom plan view of the sleeve shown in FIGS. 26-29.
Figure 30:
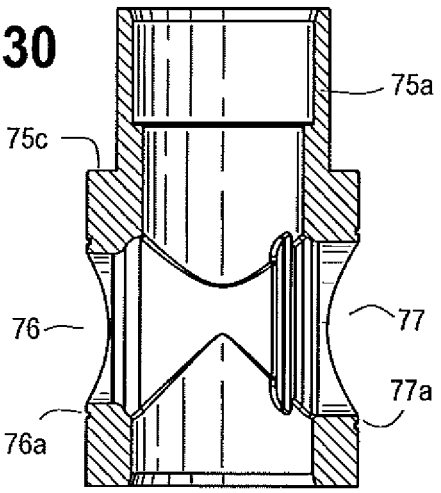
FIG. 30 is a sectional view of the sleeve shown in FIGS. 26-30 taken along the section line 30-30 of FIG. 29.
Figure 37:
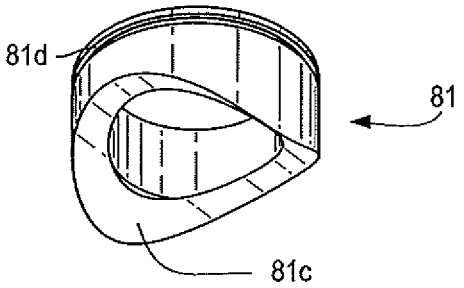
FIG. 37 is a perspective view of the upper cartridge component of said further embodiment of the present invention.
Figure 38:
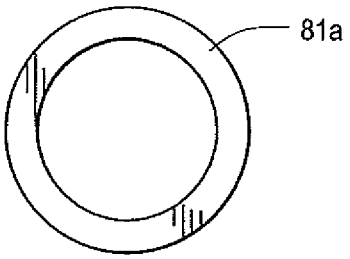
FIG. 38 is a top plan view of the upper cartridge component shown in FIG. 37.
Figure 39:
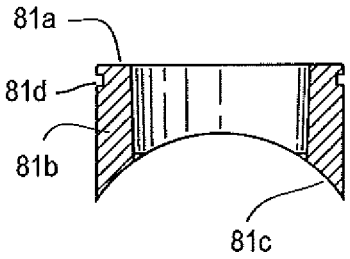
FIG. 39 is a sectional view of the upper cartridge component shown in FIGS. 37 and 38 taken along the line 39-39 of FIG. 40.
Figure 40:
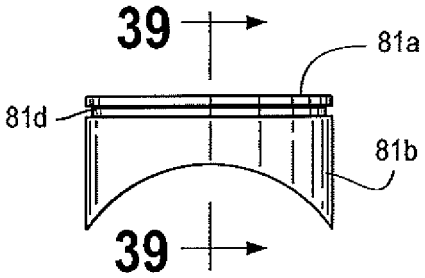
FIGS. 40 and 41 are side elevational views of the upper cartridge components shown in FIGS. 37-39.
Figure 41:
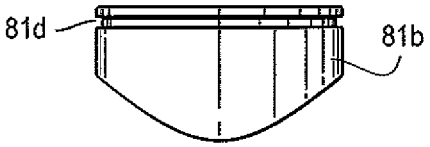
Figure 42:
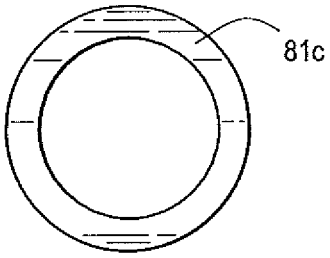
FIG. 42 is a bottom plan view of the upper cartridge component shown in FIGS. 37-42.
Figure 43:
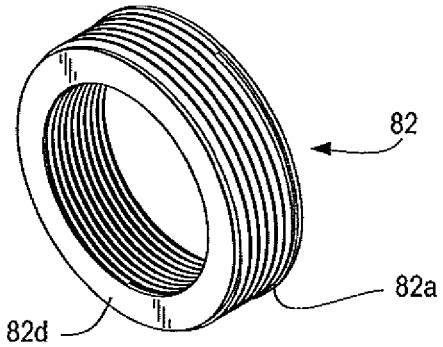
FIG. 43 is a perspective view of a locking ring component for said further embodiment.
Figure 44:
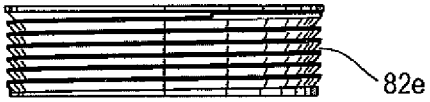
FIG. 44 is a side elevational view of the locking ring component of FIG. 43.
Figure 45:
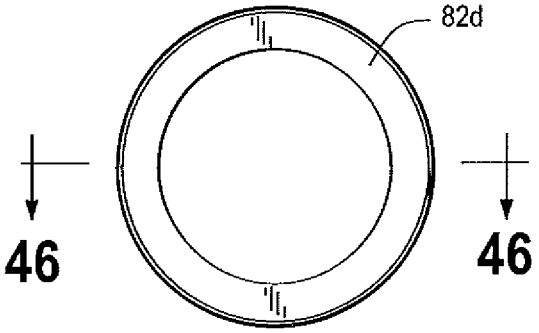
FIG. 45 is a top plan view of the locking ring shown in FIGS. 43 and 44.
Figure 46:
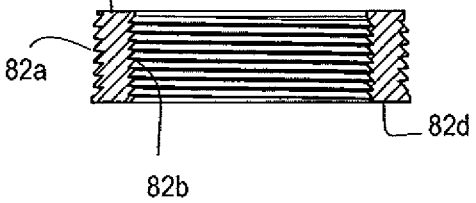
FIG. 46 is a sectional view of the sleeve spacer shown in FIGS. 43-46 taken along the section line 46-46 of FIG. 45.

FIGS. 23-25 depict a further embodiment of the present invention where like parts have like reference numerals. This embodiment is designated by the reference numeral 60 and includes a modified block 61 formed from a high strength steel forging, a modified first plunger bore 62 and a modified sleeve 63, composed of high strength stainless steel, Inonel®, Incolon® and equivalent metals and alloys. It does not require a cartridge like the cartridge 30 of the first embodiment.

As shown in FIG. 23, the modified bore includes a first section 62*a* with an enlarged diameter and a second coaxially aligned reduced diameter section 62*b*. The sleeve 63 includes a first portion 63*a* which is sized to be tightly received in the bore section 62*a* and a second portion 63*b* sized to be received in bore section 62*b* with an interference fit between surfaces of bore sections 62*a* and 62*b* and the corresponding cylindrical surface of sleeve portions 63*a* and 63*b*.

A seal carrier plate 64 has a lip 64*a* which contacts an outer end face of sleeve portion 63*a*. As shown, an annular shoulder 62*c* in the bore 62 between bore section 62*a* and 62*b* is in direct contact with an annular back face 63*e*. Lip 64*a* of seal carrier 64 and the shoulder 62*c* serve to maintain the sleeve 63 in a fixed position during fracking operations.

In accordance with an important feature of this disclosure, sleeve 63 has a pair of apertures 63*c* and 63*d*, each of which is defined by a full perimeter groove in which a gasket is received. As with cartridge 30 of the first embodiment, the gaskets are formed from a suitable material which can withstand the high pressures and chemical erosion associated with fracking operations and can include elastomers and synthetic fluorocarbon polymers that exhibit these properties which are known to those skilled in the art.

As shown in FIGS. 23 and 24, the sleeve apertures 63*d* and 63*c* can be located in the outer surface of bore 62*a* at locations designated by reference numeral 65 and 66 and provide an effective seal between the sleeve and fluid end body portions in contact therewith.

The reference numerals 67 and 68 identify high stress locations in the sleeve interior portions in the area adjacent the sleeve apertures 63*d* and 63*c* and pressurization chamber 20. As such, these areas are in locations wherein the resistance to erosion, corrosion, high stress and fatigue provided by high-strength stainless steel, Inconel®, Incoloy® and equivalents as contemplated by this disclosure is important.

As shown, an access opening 70 is enclosed by a removable retaining nut 69.

The components of the third disclosed embodiment include a sleeve component, the details of which are shown in FIGS. 26-30, a lower cartridge component, the details of which are shown in FIGS. 31-36, an upper cartridge component, the details of which are shown in FIGS. 37-42, a locking ring component, the details of which are shown in FIGS. 43-46. The assembly of these components together with conventional internal valves, seals, etc. are shown in FIG. 49.

As shown in FIGS. 26-30, the cylindrical sleeve component of this third embodiment is designated by the reference numeral 75 and can be composed of stainless steel, Inconel® and Incoloy®, as well as other metals and alloys known to those skilled in the art which provide suitable corrosion and erosion resistance and strength. Additionally, coatings and surface treatments may be applied to the surfaces of the sleeves to improve the corrosion and erosion resistant characteristics thereof. In this illustrated embodiment, sleeve component 75 includes a first sleeve portion 75*a* which extends radially outwardly into a second, enlarged sleeve portion 75*b* via a shoulder 75*c*. The outer surfaces of the first and second sleeve portions 75*a* and 75*b* are configured to be respectively received in surface-to-surface contact with a first portion of the first bore (the plunger bore) and a second portion of that bore which can be referred to as an access bore.

Figure 49:
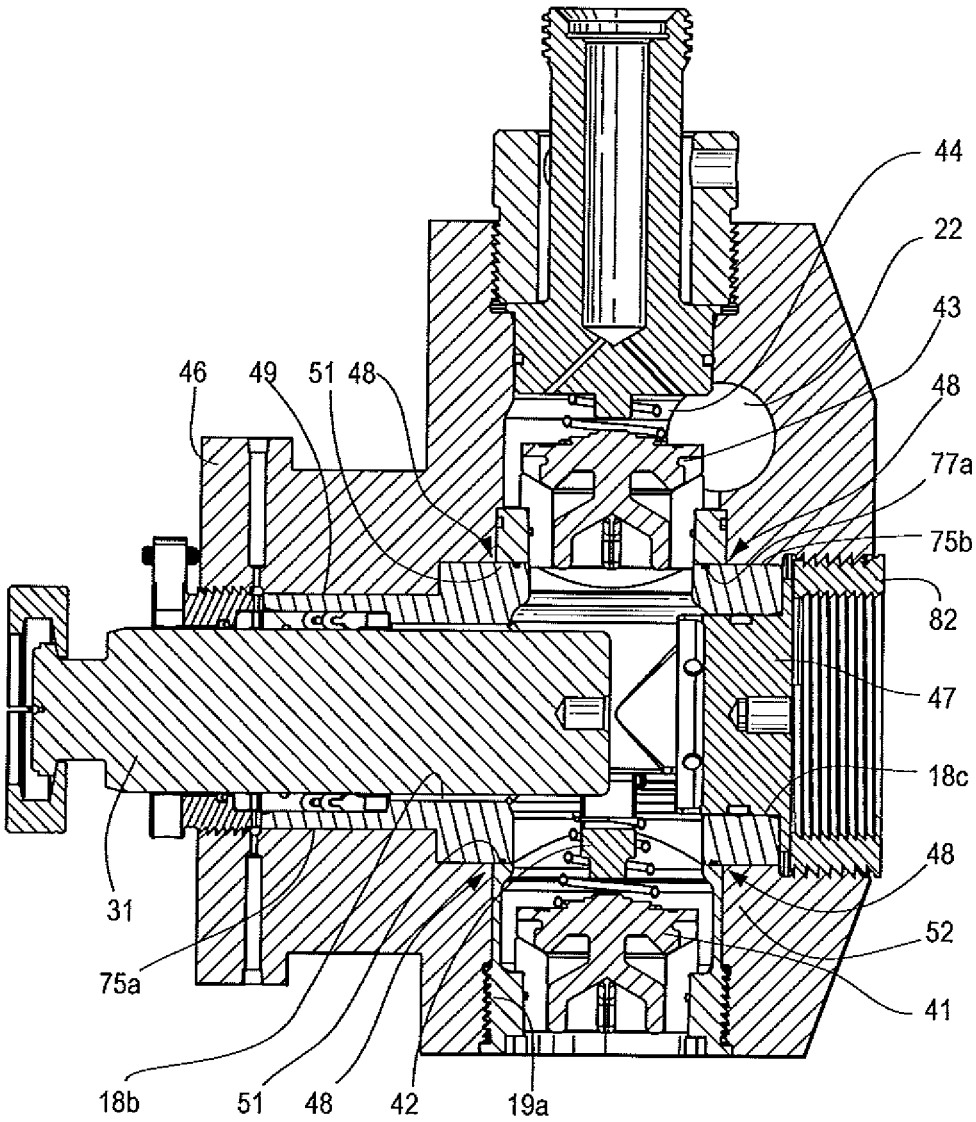
FIG. 49 is a schematic view, partially in section, illustrating the assembly of the components of said further embodiment of the present invention installed in a fluid end cylinder assembly together with the internal working elements.

Sleeve 75 includes a pair of apertures 75 and 76 which respectively communicate with an outlet of the second bore suction bore 19 and the inlet to the third bore high pressure discharge bore 21 when the sleeve is installed in a fluid cylinder of a fluid end 12 (see FIG. 49). If desired, the first and second tubular sections 75*a* and 75*b* may be in a form of two separate sleeves which are respectively received in first and second portions of the first bore.

In accordance with the present disclosure, the perimeter of each aperture 76 and 77 is respectively defined by a full perimeter groove 76*a* and 77*a* in which a gasket is received. These gaskets can be formed of a suitable material which can withstand the high pressures, chemicals and other conditions associated with fracking operations and can include synthetic fluorocarbon polymers that exhibit these properties as well as hydrogenated nitrile butadiene rubbers (HNBR), also known as highly saturated nitrile (HSN) rubbers.

In this embodiment, a lower cartridge component 80 is received in the suction bore 19 and a separate upper cartridge component 81 is received in discharge bore 21 (see FIG. 49). As shown, lower cartridge component 80 has a generally cylindrical shape which extends upwardly from an end face 80*a* into a threaded section 80*b* which is configured to mate with a threaded section 19*a* in section bore 19. A pair of notches 83 in end face 80*a* facilitate installation and removal of the lower cartridge component 80 in the suction bore 19. As shown, the upper end of lower cartridge 80 terminates in an annular end face 80*d* and includes a groove 80*e* for receiving an "O-ring" (not shown).

Upper cartridge component 81 is sized to be tightly received in high pressure discharge bore 21 and includes an annular top end face 81 which extends into a cylindrical body 81*b* having a circular bottom end face 81*c* and groove 81*d* for receiving an "O-ring" (not shown).

In accordance with an important aspect of this disclosure, the circumferential seals in the groove 76*a* and 77*a* of sleeve 75 respectively cooperate with the upper annular end face 80*d* and the lower annular end face 81*a* of upper cartridge components to form a fluid-tight seal between these contacting surfaces of the sleeve and cartridges.

As with sleeve 75, lower cartridge component 80 and upper cartridge component 81 can be composed of stainless steel, Inconel® and Incoloy® and other metal alloys exhibiting suitable corrosion and erosion resistance and strength. Correspondingly, coatings and surface treatments known to those skilled in the art may be applied to the surfaces of these components to improve the erosion and corrosion characteristics thereof.

If desired, a locking ring 82, separately shown in FIGS. 43-46, may be provided to secure or fix the position of sleeve 75 in the plunger bore 18 as generally shown in FIG. 49. Locking ring component 82 has an annular shape with external threads 82*a* and internal threads 82*b*. An end face 82*c* is sized to engage an end face 75*d* of sleeve 75 (see FIGS. 30 and 49). The external threaded portion 82 is sized to mate with the threaded access opening in the plunger bore 18 and secure the sleeve in a fixed operating position therein. The internal threads 82*b* provide a securement facility for a plug or cover (not shown).

In accordance with an important aspect of this disclosure, the sleeve and cartridge components can be machined and/or surface treated prior to their assembly into the block. This affords greater flexibility in shaping of the internal cylinder contours and results in improved performance and durability of the fluid end. In some applications, it may be preferred to machine the fluid end bore surfaces and the outside surfaces of the sleeve and cartridge components to standard dimensions while machining the internal surfaces to address the required configurations. If desired, stress in the fluid end block may be reduced by increasing the thickness of the sleeve and cartridge components to optimize the contours of the inner facing surfaces of the fluid end block. For example, by having a larger radius between intersecting bores of the block.

Figure 47:
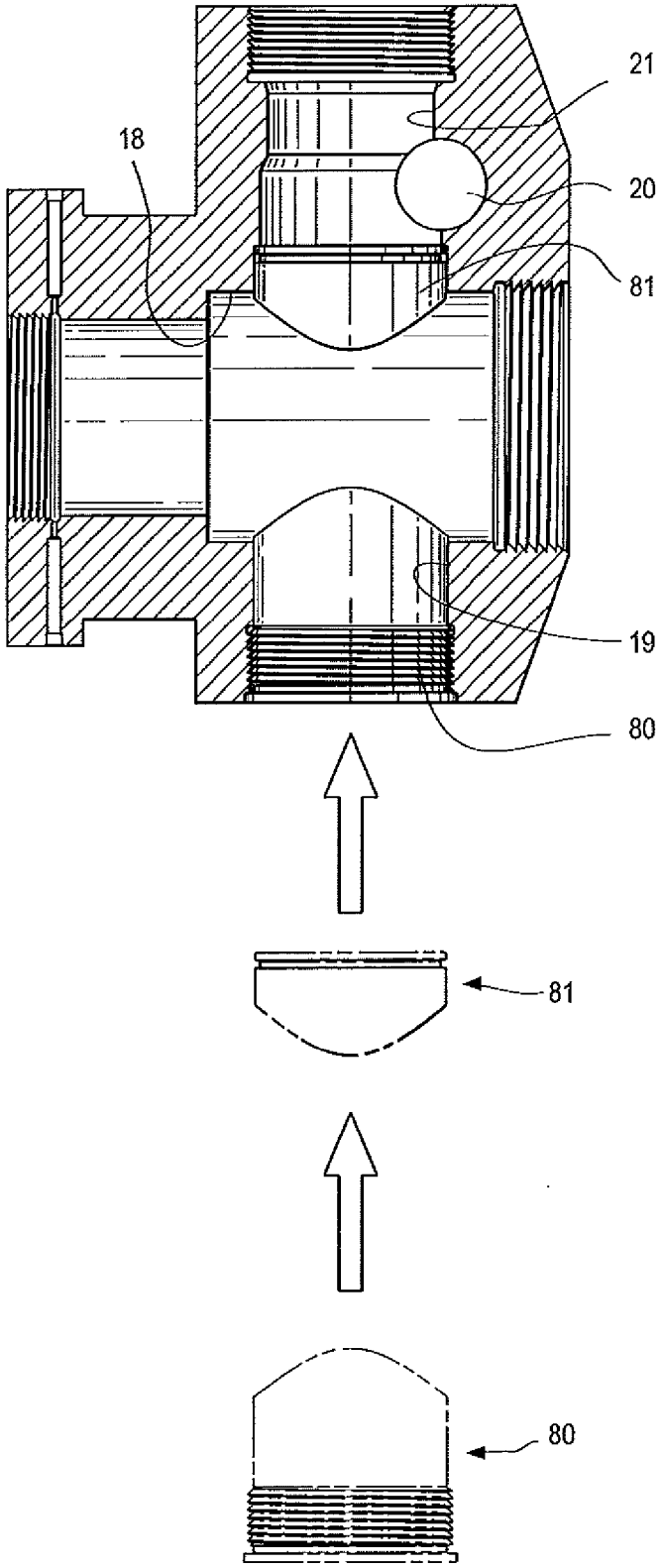
FIG. 47 is a schematic view, partially in section, illustrating a procedure for installing the upper and lower cartridges in a fluid end block in accordance with said further embodiment of the present invention.
Figure 48:
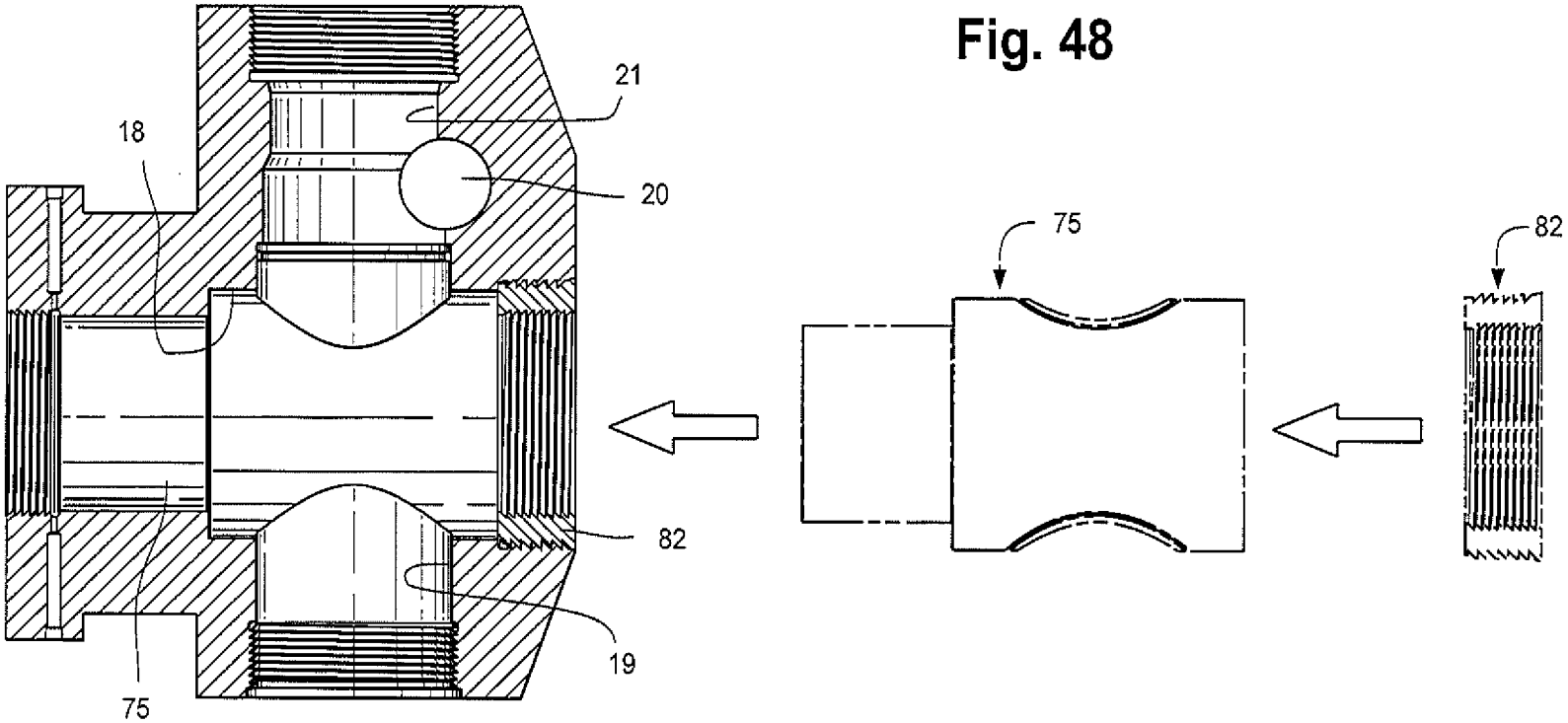
FIG. 48 is a schematic view, partially in section, illustrating a procedure for installing the sleeve component in a fluid end block in accordance with said further embodiment of the present invention.

As illustratively shown in FIG. 47, the upper and lower cartridge components can be initially installed followed by further machining to accept the subsequently installed sleeve as shown in FIG. 48.

These machining operations are done in order to assure a smooth surrounding surface on the individual bores and an equally smooth surrounding surface on the individual components. In order to insure intimate surface-to-surface direct contact between the components and the bores, the cartridge components can have a slightly larger outer diameter than the suction and discharge bores. A differential temperature between the two is then created to provide the necessary clearance during insertion and the interference fit results when the temperatures of both are normalized.

As schematically depicted in FIG. 48, after the cartridge components are installed, finish machining of the internal passageways is achieved to assure that the desired surface-to-surface contact. Again, differential temperatures between the sleeve and the bores are utilized to provide assembly clearance during insertion. Upon cooling, these differential temperatures normalize to provide a tight, interference fit between the outer surfaces of the sleeve and the inner surfaces of the plunger board 18.

FIG. 49 illustrates the fluid end cylinder assembly of the third embodiment in which the dual cartridge and single sleeve components have been incorporated along with the internal working elements (e.g., plunger, suction valve, high pressure discharge valve, etc.). As shown, plunger 31 is received in the first bore 18 and reciprocates to effect pressurization in the chamber 20 to draw fracking fluid therein at low pressure from the suction bore 19 containing a suction valve 41 and associated intake mechanism 42. Correspondingly, the high pressure discharge bore 21 receives a pressurized fracking fluid from chamber 20 and discharges the same into the high pressure passage 22 via discharge valve 43 and associated discharge mechanism 44.

Plunger packing assembly 49 and associated O-ring seals in seal carriers 46 and 47 function to prevent or at least minimize passage of fracking fluid to the fluid body portions which surround the sleeve and cartridge components. As shown in FIG. 49, corrosion resistant material strips or beads composed of a titanium-reinforced epoxy putty such as Devcon® can be utilized to minimize or eliminate seepage of fracking fluids into the portions of the fluid end bodies surrounding the sleeve end cartridge components.

As schematically depicted in FIG. 49, during operation, the regions designated by reference numeral 51 represent the highest stress location in the assembled sleeve and cartridge. Correspondingly, the regions designated by reference numeral 52 represent the highest stress locations in the block which is lower than the stress at regions 51. Since the sleeve and cartridge components, by reason of their composition, provide greater resistance to erosion and corrosion, as well as mechanical stresses and fatigues than that provided by the forged steel block, greater service life results.

As previously noted, each of the apertures 76 and 77 in sleeve 75 has a perimeter groove 76*a* and 77*a* in which a gasket is received. Those gaskets provide an effective fluid-tight seal between the gaskets contained in the sleeve apertures and the upper end of face 80*d* of lower cartridge component 80 and the lower end face 81*c* of upper cartridge component 81*c*.

While the subject invention has been disclosed and described with illustrative examples, it will be appreciated that modifications and/or changes may be made to those examples by those skilled in the art without departing from the spirit and scope of this invention as defined by the appended claims.

The invention claimed is:

1. In a fluid end of a reciprocating pump for delivery of fracking fluid at high pressure into a well for recovery of oil and natural gas trapped in shale rock formations, said fluid end having at least one fluid cylinder assembly including:

a body having a first bore which includes a reciprocating plunger;

a second bore which includes a suction valve; and a third bore which includes a discharge valve, said first bore being substantially perpendicular to both said second and third bores which are in flow communication with each other, an outlet of said second bore and an inlet of said third bore defining a chamber with said first bore that receives a reciprocating plunger for drawing fracking fluid into said chamber at low pressure and discharging said fracking fluid at high pressure;

the improvement comprising:

at least one tubular sleeve in said first bore, substantially the entire length of the outer cylindrical surface of said tubular sleeve configured to be in intimate, surface-to-surface direct contact with the surface of said first bore that surrounds said at least one tubular sleeve;

at least one tubular cartridge in a fluid passage defined by said second and third bores, substantially the entire length of the outer cylindrical surface of said at least one tubular cartridge configured to be in intimate, surface-to-surface direct contact with the surfaces of said second and third bores that surrounds said at least one tubular cartridge;

a fluid-tight seal between contacting surfaces of said at least one tubular sleeve and said at least one tubular cartridge, said fluid tight seal being formed between an outer cylindrical surface on one of said at least one tubular sleeve and said at least one tubular cartridge being in sealing contact with an annular interior-facing edge surface of the other of said at least one tubular sleeve and at least one tubular cartridge;

said at least one sleeve and said at least one cartridge, when installed in said fluid end cylinder assembly, cooperating to overlie the fluid end body portions that surround each of them and to protect them from direct impingement thereon by high pressure fracking fluid passing through said fluid end cylinder assembly.

2. The improvement of claim 1 wherein said second and third bores respectively contain first and second tubular cartridges.

3. The improvement of claim 1 wherein a gasket is provided between said at least one tubular sleeve and said at least one tubular cartridge.

4. The improvement of claim 1 wherein said at least one cartridge and said at least one sleeve is composed of a material with erosion and corrosion resistance as well as fatigue resistant properties.

5. The improvement of claim 4 wherein said material is a metal selected from the group consisting of stainless steel, Inconel®, Incoloy® and other metals and alloys exhibiting suitable corrosion resistance, erosion resistance and strength.

6. The improvement of claim 1 wherein said at least one tubular sleeve and said at least one tubular cartridge has a protective coating or surface treatment applied prior to assembly to enhance the erosion and corrosion resistance and fatigue properties thereof.

7. The improvement of claim 1 wherein there is an interference fit between the outer cylindrical surface of said at least one tubular sleeve and the surface of said first bore and between the outer cylindrical surface of said at least one tubular cartridge and the surfaces of said second and third bores.

8. The improvement of claim 1 wherein said at least one tubular sleeve includes a first portion having a first outer diameter and a second sleeve portion having a second outer diameter which is larger than said first outer diameter, said second sleeve portion being in surrounding relation to said chamber.

9. A fluid end of a reciprocating pump for delivery of fracking fluid at high pressure into a well to extract and recover oil and natural gas trapped in shale rock formations, said fluid end having at least one fluid cylinder assembly comprising:

a chamber formed therein;

a first bore in communication with said chamber, said first bore including a reciprocating plunger for effecting pressurization in said chamber to draw fracking fluid therein at low pressure and to discharge said fracking fluid at high pressure;

a second bore formed in said fluid end in communication with said chamber, said second bore including a suction valve for receiving fracking fluid at low pressure into said chamber;

a third bore formed in said fluid end in communication with said chamber, said third bore including a discharge valve for release of high pressure fracking fluid through an outlet in said fluid end;

said second and third bores defining a fluid passageway in said fluid end cylinder assembly;

at least one tubular sleeve in direct contact with said first bore, substantially the entire length of the outer cylindrical surface of said tubular sleeve configured to be in an interference fit with the surface of said first bore that surrounds said at least one tubular sleeve;

at least one tubular cartridge in the third bore of said fluid passageway, substantially the entire length of the outer cylindrical surface of said at least one tubular cartridge configured to be in an interference fit with the surface of said third bore surrounding said at least one tubular cartridge;

a fluid tight seal between contacting surfaces of said at least one sleeve and said at least one cartridge;

said at least one sleeve and said at least one cartridge cooperating to overlie the fluid end body portions surrounding each of them and to protect said underlying fluid body portions from direct impingement thereon by high pressure fracking fluid passing through said fluid end.

10. The fluid end of claim 9 wherein said second bore contains a second tubular-cartridge, substantially the entire length of the outer cylindrical surface of said second tubular cartridge configured to be in an interference fit with the surface of said second bore surrounding said second tubular cartridge.

11. The fluid end of claim 9 in which an outer cylindrical surface on one of said at least one tubular sleeve and said at least one tubular cartridge is in fluid tight sealing contact with an annular interior-facing edge surface of the other of said at least one tubular sleeve and said at least one tubular cartridge.

12. The fluid end of claim 9 edge surface wherein said at least one cartridge and said at least one sleeve composed of a material with erosion and corrosion resistance as well as fatigue resistant properties.

13. The fluid end of claim 12 wherein said material is a metal selected from the group consisting of stainless steel, Inconel®, Incoloy® and other metals and alloys exhibiting suitable corrosion resistance, erosion resistance and strength.

14. The fluid end of claim 13 wherein said at least one tubular sleeve and said at least one tubular cartridge has a protective coating or surface treatment applied to enhance the erosion and corrosion resistance and fatigue properties thereof.

15. The fluid end of claim 9 wherein said at least one tubular sleeve includes a first portion having a first outer diameter and a second portion having a second outer diameter which is larger than said first outer diameter, said second being in surrounding relation to said chamber.

16. A fluid end of a reciprocating pump for delivery of fracking fluid at high pressure into a well to extract and recover oil and natural gas trapped in shale rock formations, said fluid end having at least one fluid cylinder assembly comprising:

a chamber;

a first bore in communication with said chamber, said first bore including a reciprocating plunger for effecting pressurization in said chamber to draw fracking fluid at low pressure and to discharge said fracking fluid at high pressure;

a second bore including a suction valve in flow communication with said chamber;

a third bore in flow communication with said chamber, said third bore including a discharge valve in flow communication with an outlet in said fluid end;

a tubular sleeve in said first bore, substantially the entire length of the outer surface of said tubular sleeve being in intimate, surface-to-surface direct contact with the surface of said first bore surrounding said tubular sleeve;

a first tubular cartridge in said second bore, substantially, the entire length of the outer surface of said first cartridge being configured to be in intimate, surface-to-surface direct contact with the surface of said second bore;

a second tubular cartridge in said third bore, substantially the outer surface of the entire length, said second cartridge being configured to be in intimate, surface-to-surface direct contact with the surface of said third bore;

said sleeve having a first aperture in flow communication with an outlet end of said first cartridge;

a first seal between the perimeter of said first aperture and the outlet of said first cartridge;

said sleeve also having a second aperture in flow communication with an inlet to said second cartridge;

said chamber being interposed between said first and second apertures;

a second seal between the perimeter of said second aperture and s the inlet to said second cartridge;

said first cartridge, sleeve and second cartridge defining a flow passageway for said fracking fluid which protects the body portions of said fluid body which they overlie and which protects those body portions from direct impingement by high pressure fracking fluid passing therethrough.

17. The fluid end of claim 16 wherein said first seal includes an O-ring in the periphery of said first aperture which provides a fluid tight seal with an annular contact surface with the outlet end of said first cartridge.

18. The fluid end of claim 16 wherein said second seal is formed by an O-ring in the periphery of said second aperture which provides a fluid tight seal with said inlet and of said second cartridge.

19. The fluid end of claim 16 wherein there is an interference fit between the outer surface of said sleeve and the surface of said first bore.

20. The fluid seal of claim 16 wherein there is an interference fit between the outer surface of said first cartridge and the surface of said second bore.

21. The fluid end of claim 16 wherein there is an interference fit between the outer surface of said second cartridge and the surface of said third bore.

22. The fluid end of claim 16 wherein said sleeve, and first and second cartridges, are composed of a material with corrosion and erosion resistance as well as fatigue-resistant properties.

23. The fluid end of claim 16 wherein said tubular sleeve includes a first portion having a first outer diameter and a second sleeve portion having a second outer diameter which is larger than said first outer diameter, said second sleeve portion being in surrounding relation to said chamber.

24. A fluid end of a reciprocating pump for delivery of a fracking fluid at high pressure into a well to extract and recover oil and natural gas trapped in shale rock formations, said fluid end having at least one fluid cylinder assembly comprising:

a chamber formed therein;

a first bore in communication with said chamber, said first bore including a reciprocating plunger for effecting pressurization in said chamber to draw fracking fluid therein at low pressure and to discharge said fracking fluid at high pressure therefrom;

a second bore formed in said fluid end in communication with said chamber, said second bore including a suction valve for receiving fracking fluid at low pressure;

a third bore formed in said fluid end in communication with said chamber, said third bore including a discharge valve for release of high pressure fracturing fluid through an outlet in said fluid end;

a tubular sleeve having first and second sleeve portions, a first tubular sleeve portion having an interior edge portion received in a first portion of said first bore, substantially the entire length of the outer surface of said first tubular sleeve portion configured to be in intimate surface-to-surface direct contact with the surface of said first bore portion surrounding said first tubular sleeve portion;

substantially the entire length of said second tubular sleeve portion configured to be in intimate surface-to-surface direct contact with a second portion of said first bore;

a tubular cartridge received in said second and third bores, the outer surface of said cartridge configured to be in intimate surface-to-surface direct contact with the surfaces of said second and third bores; and a tubular plug threadedly received in a lower end of said second bore, said plug having an upper surface which is in contact with a bottom edge of said tubular cartridge to secure said cartridge in a fixed operating position in said second bore;

whereby, said first and second sleeves and cartridge cooperate to protect the fluid end body portions surrounding said sleeves and cartridge from direct impingement thereon by high pressure fracking fluid passing therethrough.

25. The fluid end of claim 24 wherein the interior edge portions of said first and second sleeve portions are coupled to each other by integral bridging portions.

26. The fluid end of claim 24 wherein at least one of said first and second sleeve portions and cartridge is composed of material with erosion and corrosion resistance and fatigue resistant properties.

27. The fluid end of claim 24 wherein at least one of said first and second sleeve portions and cartridge has a protective coating or surface treatment applied to enhance the erosion and corrosion resistance and fatigue properties thereof.

28. The fluid end of claim 24 wherein a gasket is provided between said sleeve and cartridge.

29. The fluid end of claim 28 wherein an aperture in one of said sleeve portions includes a gasket which provides an effective seal between an outer cylindrical surface of said cartridge and said sleeve portion.

30. The fluid end of claim 24 wherein a corrosion resistant material seals the outside surfaces at a junction between said cartridge and said first or second tubular sleeves.

31. The fluid end of claim 24 wherein there is an interference fit between the contacting surfaces of said first and second portions of said first bore and the cylindrical surfaces of the first and second tubular sleeve portions in contact therewith.

32. The fluid end of claim 24 wherein there is an interference fit between the outer surface of said cartridge and the surfaces of said second and third bores in contact therewith.

33. A fluid end of a reciprocating pump for delivery of a fracking fluid at high pressure into a well to extract and recover oil and natural gas trapped in shale rock formations, said fluid end having at least one fluid cylinder assembly comprising:

a chamber formed therein;

a first bore in communication with said chamber, said first bore including a reciprocating plunger for effecting pressurization in said chamber to draw fracking fluid therein at low pressure and to discharge said fracking fluid at high pressure therefrom;

a second bore formed in said fluid end in communication with said chamber, said second bore including a suction valve for receiving fracking fluid at low pressure into said chamber;

a third bore formed in said fluid end in communication with said chamber, said third bore including a discharge valve for release of high pressure fracturing fluid through an outlet in said fluid end;

a tubular sleeve received in said first bore and extending through said chamber, substantially the entire length of outer cylindrical surface of said tubular sleeve being in intimate, surface-to-surface direct contact with the surface of said first bore surrounding said tubular sleeve;

first and second flow passage apertures in said tubular sleeve in alignment with said second and third bores;

a discharge outlet of said suction valve in contact with the surrounding edge of said first aperture;

an inlet of said discharge valve in contact with the surrounding edge of said second aperture; said sleeve being configured to protect the fluid end body portions surrounding said sleeve from direct impingement thereon by high pressure fracking fluid passing therethrough.

34. The fluid end of claim 33 wherein said sleeve is composed of material with erosion and corrosion resistance and fatigue resistant properties.

35. The fluid end of claim 33 wherein at least said sleeve has a protective coating or surface treatment applied to enhance the erosion and corrosion resistance and fatigue properties thereof.

36. The fluid end of claim 33 wherein each of said first and second apertures include a perimeter groove in which a gasket is received, each said gasket having a composition and configuration which respectively provides an effective seal with said discharge outlet of said suction valve and inlet of said discharge valve.

37. The fluid end of claim 33 wherein said tubular sleeve includes a first portion having a first diameter and a second sleeve portion having a second outer diameter which is larger than said first outer diameter, said second sleeve portion being in surrounding relation to said chamber.

38. The fluid end of claim 33 wherein there is an interference fit between the outer cylindrical surface of said tubular sleeve and surface of said first bore.

* * * * *